US008283863B2

(12) United States Patent
Morimoto et al.

(10) Patent No.: US 8,283,863 B2
(45) Date of Patent: Oct. 9, 2012

(54) XENON SHORT ARC LAMP FOR DIGITAL A PROJECTOR

(75) Inventors: Shunichi Morimoto, Hyogo (JP); Tetsuya Kitagawa, Hyogo (JP); Akiko Uchino, Hyogo (JP); Tomoyoshi Arimoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 100 days.

(21) Appl. No.: 12/801,997

(22) Filed: Jul. 7, 2010

(65) Prior Publication Data

US 2011/0006675 A1 Jan. 13, 2011

(30) Foreign Application Priority Data

Jul. 7, 2009 (JP) ..... 2009-160924

(51) Int. Cl.
*H01J 61/30* (2006.01)
*H01J 17/24* (2012.01)

(52) U.S. Cl. ..... 313/562; 313/634

(58) Field of Classification Search ..... 313/562, 313/623–625, 634–636, 493, 318.12, 570; 118/50; 445/26, 27

See application file for complete search history.

(56) References Cited

U.S. PATENT DOCUMENTS

| | | | | |
|---|---|---|---|---|
| 4,906,895 | A * | 3/1990 | Pabst et al. | 313/632 |
| 5,541,481 | A * | 7/1996 | Yamaguchi et al. | 313/638 |
| 5,629,585 | A * | 5/1997 | Altmann et al. | 313/570 |
| 5,929,565 | A * | 7/1999 | Mayama et al. | 313/631 |
| 6,215,247 | B1 * | 4/2001 | Kurano et al. | 313/631 |
| 6,227,926 | B1 * | 5/2001 | Kurano et al. | 445/51 |
| 2006/0091800 | A1 * | 5/2006 | Arnold | 313/578 |
| 2006/0103305 | A1 * | 5/2006 | Bunk et al. | 313/578 |

FOREIGN PATENT DOCUMENTS

JP 10-283921 A 10/1998

* cited by examiner

*Primary Examiner* — Anh Mai
*Assistant Examiner* — Elmito Breval
(74) *Attorney, Agent, or Firm* — Rader, Fishman & Grauer PLLC

(57) ABSTRACT

A xenon short arc lamp for a digital projector, includes an anode, a cathode having a cathode main body that is made of tungsten containing electron emissive material, and an arc tube made of silica glass, wherein a supply source of carbon is formed on a metal portion in the arc tube except a tip area of the cathode, and the carbon is supplied to the tip of the cathode through a gaseous phase during lamp lighting, so that a surface layer of the cathode is melt.

13 Claims, 8 Drawing Sheets

| | Unit | For film | Digital Projector for DLP | | | | | | | |
|---|---|---|---|---|---|---|---|---|---|---|
| | | Lamp 1 | Lamp 2 | Lamp 3 | Lamp 4 | Lamp 5 | Lamp 6 | Lamp 7 | Lamp 8 | Lamp 9 |
| | | Ref. Ex.1 | Ref. Ex.2 | Ref. Ex.3 | Em. 1 | Em. 2 | Em. 3 | Em. 4 | Em. 5 | Em. 6 |
| Power | W | 3,500 | 4,000 | 4,000 | 4,000 | 4,000 | 4,000 | 4,000 | 4,000 | 4,000 |
| Voltage | V | 27 | 30.8 | 30.8 | 30.8 | 30.8 | 30.8 | 30.8 | 30.8 | 30.8 |
| Current | A | 130 | 130 | 130 | 130 | 130 | 130 | 130 | 130 | 130 |
| Diameter of cathode tip | mm | 0.9 | 0.6 | 0.6 | 0.6 | 0.6 | 0.6 | 0.6 | 0.6 | 0.6 |
| Current density | $A/cm^2$ | 104 | 119 | 119 | 119 | 119 | 119 | 119 | 119 | 119 |
| Bulb wall loading | $W/cm^2$ | 20.6 | 37.5 | 37.5 | 37.5 | 37.5 | 37.5 | 37.5 | 37.5 | 37.5 |
| Cone angle | Degrees | 40 | 60 | 60 | 60 | 60 | 60 | 60 | 60 | 60 |
| Inner surface area of arc tube | $cm^2$ | 170 | 107 | 107 | 107 | 107 | 107 | 107 | 107 | 107 |
| Arc tube inner volume | $cm^3$ | 217 | 135 | 135 | 135 | 135 | 135 | 135 | 135 | 135 |
| Pressure of enclosed xenon gas | MPa | 0.6 | 1.6 | 1.6 | 1.6 | 1.6 | 1.6 | 1.6 | 1.6 | 1.6 |
| OH concentration of arc tube inner surface | wt-ppm | 5 | 5 | 100 | 100 | 100 | 350 | 350 | 350 | 350 |
| OH concentration of inside of arc tube | wt-ppm | 5 | 5 | 5 | 5 | 5 | 5 | 5 | 5 | 5 |
| OH group / inner volume | $\mu mol/cm^3$ | 0.008 | 0.008 | 0.15 | 0.15 | 0.54 | 0.54 | 0.54 | 0.54 | 0.54 |
| Carbon quantity / inner volume | $\mu mol/cm^3$ | 1.8 | 2.1 | 2.1 | 2.4 | 3.0 | 3.0 | 5.2 | 3.0 | 3.0 |
| Tantalum quantity / carbon quantity molar ratio | | 23 | 31 | 31 | 28 | 22 | 22 | 13 | 11 | 22 |
| Temperature of tantalum getter | °C | 1,200 | 1,300 | 1,300 | 1,300 | 1,300 | 1,300 | 1,300 | 1,300 | 1,400 |
| Life span as to flicker | h | 3,500 | 260 | 310 | 470 | 540 | 650 | 910 | 720 | 780 |

FIG. 4

XENON SHORT ARC LAMP FOR DIGITAL A PROJECTOR

CROSS-REFERENCES TO RELATED APPLICATION

This application claims priority from Japanese Patent Application Serial No. 2009-160924 filed Jul. 7, 2009, the contents of which are incorporated herein by reference in its entirety.

TECHNICAL FIELD

The present invention relates to a xenon short arc lamp for a digital projector that is used as a light source of a digital projector, using a technology such as a DLP (Digital Light Processing (Registered Trademark)), which uses a DMD (Digital Micromirror Device (Registered Trademark)).

BACKGROUND

Conventionally, a film projector for irradiating a 35 mm (millimeters) film with light through an aperture so as to project an image on a screen is generally used in a movie screening system of a movie theater. FIG. 9 is an explanatory diagram of the structure of a projector for a movie film. Image frames (hereinafter referred to as merely frames) containing continuous content are recorded on a film 71 at predetermined intervals. This film 71 is transported by a transport mechanism (not shown in the figure) and passes through a picture gate unit 72 from an upper part to a lower part thereof. Light emitted from a light source apparatus 73 is condensed and passes through an aperture formed in the picture gate unit 72, so that a frame recorded on the film 71 is irradiated with light. The size of each frame of the film 71 is, for example, approximately 24×18 mm and a diagonal thereof is approximately 30 mm. Therefore, in order to efficiently irradiate the area of the film, the light source apparatus 73 is required to have a structure in which the light from a light source lamp is efficiently condensed so that the light may incident within a circle whose diameter is approximately 30 mm at the picture gate unit 72.

Therefore, the light source apparatus 73 includes a xenon short arc lamp 73*a* (hereinafter referred to as a xenon lamp), which serves as a light source lamp, and a reflection mirror 73*b* which is arranged at a rear portion thereof. And, the reflection mirror 73*b* has a reflective surface made up of a spheroidal surface, which condenses the light emitted from the xenon lamp 73*a* so that the light may incident within a circle, wherein, as mentioned above, the diameter of the circle is approximately 30 mm. As shown as an optical path in the figure, the light emitted from the xenon lamp 73*a* is reflected by the reflection mirror 73*b*, is condensed at a second focal point (F2), passes though the film 71, is expanded by a projection lens 74, and is projected on a screen 75.

However, the optical path shown in this figure is ideal in such a system. However, an arc of the xenon lamp 73*a* does not actually serve as a point light source, but has a finite size in fact. For this reason, the light from the arc is not condensed at one point, so that an inside area of a circle having a certain size is irradiated with light at a position of the second focal point. And it is known that, in case the same ellipse mirror is used, an irradiated area at the position of the second focal point becomes large approximately in proportion to a cross section area of an arc (an area of the arc when viewed from a side thereof).

Given such a situation, a xenon lamp, in which an arc length is approximately 3-7 mm, is used as a light source for a film projector, in order that the inside area of the circle having a diameter of approximately 30 mm is irradiated with light. In addition, the "arc length" is equal to the distance between electrodes at a time of steady lighting of a lamp. Furthermore, a numerical example of the specification of such a xenon lamp for a film projector will be given below. For example, the rated power consumption thereof is 0.9-6.0 kW, a diameter at a tip of a cathode is 0.6-1 mm, the pressure of enclosed xenon is 0.6-0.9 MPa, the current density at the tip of the cathode is 76-110 A/mm$^2$, and the bulb wall loading thereof is 18-29 W/cm$^2$. In the above example of the specification, when concrete numerical values of the xenon lamp for a film projector whose rated power consumption is 4 kW, numerical values will be given below. The arc length is 6 mm, the diameter of the tip of the cathode is 0.9 mm and the pressure of enclosed xenon is 0.7 MPa, the current density thereof is 108 A/mm$^2$, and the bulb wall loading thereof is 25 W/cm$^2$. In addition, in the above description, the "current density" means current density which is obtained by dividing lamp current by a cross section area of the cathode at a position of 0.5 mm from the tip of the cathode, and the "bulb wall loading" means electric power per unit area, which is obtained by dividing lamp electric power by the inner surface area of an arc tube portion.

Since the xenon lamp emits high intensity light, the temperature of the tip of the electrode becomes extremely high. For this reason, the tip of the cathode that emits electrons is consumed intensely. When the tip of the electrode is worn out so that unevenness is formed on a face of the tip of the cathode, a phenomenon commonly referred to as "flicker" occurs in which a starting point of arc electric discharge moves between a convex portion and another convex portion. When this flicker occurs, the luminance distribution of the lamp fluctuates so that it appears as flickering on a screen.

In order to prevent occurrence of such a flicker (i.e., in order to obtain the stable radiation light over an extended time period), improvement in such a xenon lamp has been repeated. For example, tungsten, to which thoria ($ThO_2$) whose melting point is high even in electron emissive material is added, is used for a cathode, and a carbonization layer with a thickness of 8-30 μm (micrometers), which is made of tungsten carbide ($W_2C$), is formed thereon except the vicinity of the tip thereof. By forming this carbonization layer thereon, the electron emissive material (for example, thoria ($ThO_2$)) added in the cathode is reduced by carbon, thereby generating thorium (Th) at time of lamp lighting, so that the thorium (Th) can be efficiently supplied to the tip face of the cathode. Such technology is disclosed, for example, in Japanese Patent Application Publication No H10-283921.

The above-mentioned carbonization layer is not (should not be) formed on the tip portion of the cathode. This is because an area of the tip portion of the cathode reaches high temperature, for example, approximately 2,900° C., so that if tungsten carbide ($W_2C$), whose melting point is low, exists therein, it melts at an early stage, whereby the electrode is worn out, or the arc tube is blackened, so that the intensity of radiation light decreases, and thus the lamp come to the end of its life span at an early stage. In a xenon lamp, which is optimized by applying such technology to the above described lamp for a film projector, the quantity of carbon is in a range of 0.5-1.8 μmol/cm$^3$ per unit internal volume of the arc tube.

Moreover, silica glass is usually used for such an arc tube. Therefore, since problems, such as a rise of starting voltage or blackening of the arc tube, may arise, when water, which is originated from OH groups contained in the silica glass, is discharged in the lamp with lighting of the lamp, the arc tube in which the OH group concentration is low is generally used. The OH group concentration of such an arc tube is maintained to a level of raw material in a state of a pre-formation thereof, by using dried gas ($N_2$) in a forming step of blowing up the arc tube.

As the result of these improvements, a life span of the xenon lamp as to a flicker reaches approximately 3,500 hours. Thus, it is possible to sufficiently realize a long usage life thereof, since the starting nature of the lamp has been improved and the problem of the blackening has been improved.

In addition, in recent years, in the movie screening system of a movie theater, the advanced computer graphics using the digital technology, by which the quality of an image is improved, can be realized. Therefore, since there are advantages that there is no degradation of the film, and costs accompanying film production can be reduced, the digital cinema becomes widespread. In accordance with the spread, the digital projector which uses a DLP (Digital Light Processing: Registered Trademark) technology is replacing the old system at a rapid pace.

An example of the structure of such a digital projector is shown in FIG. 10. In this digital projector 80, light from a xenon lamp 81 is condensed by a reflection mirror 82 having an ellipse reflective face, and irradiates image elements called a DMD (Digital Micromirror Device: Registered Trademark) through a color filter 83, an integrator rod 84, and condensing lenses 85*a* and 85*b*. The light reflected by the DMD 86 is projected on a screen 88 by a projection lens 87, so that an image is shown thereon.

In such a digital projector 80, the light from the xenon lamp 81 must be condensed at high efficiency so as to be incident on an end face of the integrator rod 84. Thus, the light must be condensed at high efficiency, because the end face of the integrator rod 84 usually has a size which is comparable with the DMD 86 in which a diagonal line is as short as a 0.7-1 inch (17.8-25.4 mm), so that in order to project an image with brightness comparable with that of a conventional projector for a movie film, on a screen, the light must be condensed in a small area within a range of 35-70% of an area in the case of the projector for a movie film.

Since an area irradiated by the reflection mirror 82 is approximately proportional to a cross section area of an arc, it is necessary to use the xenon lamp in which the arc length is shorter and the pressure of enclosed xenon is further increased in order to make the arc thin in the xenon lamp 81 for a direct projector. Consequently, the arc length of the xenon lamp 81 is set to approximately 2-7 mm, and 1 MPa or more of the pressure of the enclosed xenon gas is required at a normal temperature wherein specifically, the pressure thereof in the range of 1-2 MPa thereof is required. And in order to bear the high pressure in an operation at a time of lamp lighting, it is necessary to miniaturize the arc tube so as to be smaller than that of the prior art, and thereby the bulb wall loading of the xenon lamp for a digital projector increases to 30 W/cm$^2$ or more, and specifically the bulb wall loading within a range of 30-40 W/cm$^2$ is required. This is remarkably high, even compared with a conventional xenon lamp for a film projector.

In addition, shortening of a distance between the focal points of an ellipse reflective face (a distance between F1 and F2) may be also considered as a means for making small the area irradiated with light from the reflection mirror 82. However, this method cannot be adopted in the above described case, since the rate of rays which have a large angle with respect to an optical axis 89 increases, so that the light which does not reach the DMD element increases, whereby the utilization ratio of light decreases. In other words, when the irradiated area becomes small, it is difficult to raise the condensing efficiency thereof by only devising an optical system.

Furthermore, it is necessary to increase an optical output of the xenon lamp 81 because of a demand on a brighter image of a digital projector. For this reason, from a viewpoint of reducing rays from the arc which are blocked by the cathode, a diameter of the tip of the cathode is required to be smaller than that of the prior art. Therefore, the diameter thereof is, for example, 0.35-0.7 mm, so that the diameter of the tip of the cathode of the lamp for a digital projector is smaller than that of the prior art. Consequently, the current density of the tip of the cathode also becomes high, specifically 119 A/mm$^2$ or more, and particularly it is in a range of 119-210 A/mm$^2$.

In an example of such specification, more concrete numerical values of the xenon lamp for a digital projector, in which the rated power consumption is 4 kW, will be given below. The arc length thereof is 3.5 mm, the diameter of the tip of the cathode is, 0.6 mm, the pressure of enclosed xenon is 1.8 MPa, the current density thereof is 119 A/mm$^2$, and the bulb wall loading thereof is 37.5 W/cm$^2$. In addition, as mentioned above, the "current density" means current density that is obtained by dividing lamp current by a cross section area at a position of 0.5 mm from the tip of a cathode, and the "bulb wall loading" means electric power per unit area, which is obtained by dividing lamp electric power by an inner surface area of an arc tube portion.

The features of such a xenon short arc lamp for a digital projector are summarized below. The pressure of enclosed xenon gas is high; the bulb wall loading thereof (a value which is obtained by dividing lamp electric power by an inner surface area of a portion where the arc tube is swollen) is high as a result of miniaturizing an arc tube in order to bear the high operation pressure; and the current density thereof becomes high as a result of making small the diameter of the tip of the cathode. Concrete numerical values about the above case will be given below. The pressure of enclosed xenon gas is 1 MPa or more, the bulb wall loading thereof is 30 W/cm$^2$ or more, the current density of the tip face of the cathode is 119 A/mm$^2$ or more. Thus, the very severe specification is required. And when the above requirements of specification is satisfied, the temperature of the tip of the cathode of the xenon lamp rises further, so that consumption and deformation of the tip portion of the cathode makes remarkably rapid progress, and after lamp lighting, the tip face of the cathode becomes large and unevenness is formed thereon, whereby a flicker occurs at an early stage in a short time. And, in the conventional technology, for example, even if the life span as to flicker of the xenon lamp is improved according to formation of a carbonization layer or adjustment of the shape at the tip of the cathode, a life span thereof comes to the end in very short period of only 200-350 hours after it is lighted.

SUMMARY

The present invention is made in order to solve such problems, and it is an object of the present invention to offer a xenon short arc lamp for a digital projector with a long usage life span in which, on a tip face of a cathode, a formation of unevenness is prevented over a long time period after lamp lighting, and the flicker phenomenon is suppressed for a long time.

(1) In order to solve the above-mentioned problems, the present xenon short arc lamp for a digital projector according to the present invention, comprises an anode, a cathode having a cathode main body which is made of tungsten including electron emissive material, and an arc tube made of silica glass, wherein a carbon supply source is formed on at least a metal portion of the arc tube except a tip area of the cathode, and carbon is supplied to the tip of the cathode through a gaseous phase during lamp lighting, and a surface layer of the cathode tip is melt.

(2) Or, a xenon short arc lamp for a digital projector according to the present invention comprises an anode, a cathode having a cathode main body which is made of tungsten including electron emissive material, and an arc tube made of silica glass, wherein a surface layer of a tip face of the cathode can have stripe phases of carbide of tungsten in a phase of tungsten (W).

(3) In the present xenon short arc lamp for a digital projector, the pressure of xenon gas enclosed inside the arc tube can be 1 MPa or more, the bulb wall loading can be 30 W/cm$^2$ or more and the current density of the tip face of the cathode can be 119 A/mm$^2$ or more.

(4) In the inside of the arc tube of the present xenon short arc lamp for a digital projector, carbon and/or carbide of 2.4 μmol/cm$^3$ or more per unit internal volume of an arc tube when converted into carbon (C), can be included.

(5) In the xenon short arc lamp for a digital projector, OH group concentration in the inner surface of the arc tube is 100 wt-ppm or more.

(6) In the xenon short arc lamp for a digital projector, the quantity of the OH group contained in the arc tube can be 0.15 μ/cm$^3$ or more per unit internal volume of the arc tube.

(7) In the xenon short arc lamp for a digital projector, a getter made of tantalum or a tantalum compound in the inside of the arc tube is provided, wherein the molar ratio of the tantalum which is contained in the getter to the carbon, is 11 or less.

(8) In the xenon short arc lamp for a digital projector, a getter made of tantalum or a tantalum compound in the inside of the arc tube is formed, wherein the getter is attached to a potion where attained temperature of the getter can be 1,400° C. or more during lamp lighting.

Effects of the present invention will be described below.

(1) In the xenon short arc lamp for a digital projector according to the first invention, since carbon is supplied to the tip face of the cathode during lamp lighting through a gaseous phase, it is possible to form carbide of tungsten on a surface thereof by reacting tungsten therewith and, since the carbide of tungsten melts, without changing the shape of the tip of the cathode, it is possible to reform a smooth spherical face with surface tension due to melting of the tip portion. Consequently, it becomes difficult for unevenness to be formed at the tip of the cathode, and generation of the flicker phenomenon, which originates from the movement of a starting point of an arc, is suppressed for a long time, so that the xenon short arc lamp for a digital projector with a long usage life span can be realized.

(2) In the xenon short arc lamp for a digital projector according to the second invention, since the carbide of tungsten can melt during lamp lighting, a smooth spherical face is reformed by surface tension, without changing the shape of the tip of the cathode, due to fusion of only the tip portion thereof, so that the surface layer of the tip face of the cathode may have two or more linear stripe phases of tungsten carbide in a phase of tungsten (W) after extinction of the lamp. In such a xenon short arc lamp, unevenness is hard to be formed at the tip of the cathode, so that it is possible to suppress generation of the flicker phenomenon which originates from the movement of a starting point of an arc for a long time, and it is possible to form a xenon short arc lamp for a digital projector with a long usage life span.

(3) In the xenon short arc lamp for a digital projector according to the third invention, the pressure of xenon gas enclosed inside the arc tube can be 1 MPa or more, the bulb wall loading thereof can be 30 W/cm$^2$ or more and the current density of the tip face of the cathode can be 119 A/mm$^2$ or more. Even in the case where light must be condensed on a small area whose diagonal line is as short as 0.7-1 inch (17.8-25.4 mm), the utilization ratio of light can be increased, and the high illumination of a screen can be maintained sufficiently, so that a xenon short arc lamp that is suitably used for a digital projectors can be offered.

(4) In the xenon short arc lamp for a digital projector according to the fourth invention, there can be sufficient carbon (C) therein so that the carbon can be supplied certainly to the tip of the cathode, whereby it is possible to generate carbide of tungsten at the tip of the cathode over a long time period. Consequently, since only the surface layer of the tip can be melted without greatly melting the tip of the cathode, so that a smooth spherical face can be reformed by surface tension, generation of unevenness is generally avoided at the tip of the cathode, and generation of the flicker phenomenon is suppressed for a long time, so that the xenon short arc lamp for a digital projector with a long usage life span can be made.

(5) According to the fifth invention, since OH group contained in the inner surface of the arc tube can be discharged as water ($H_2O$) in the arc tube during lamp lighting, carbon monoxide gas (CO) is generated reacting with carbon or carbon compounds in the cathode or the anode, and the CO diffuses in the arc tube in a state of a gaseous phase, so that it is possible to generate carbide of tungsten at the tip of the cathode by the CO that reaches the arc.

(6) According to the sixth invention, since there can be sufficient water ($H_2O$) for generating CO so that the CO can be supplied certainly in a gaseous phase, it is possible to prevent generation of unevenness on the tip face of the cathode over a long time period, whereby generation of a flicker phenomenon can be suppressed for a long time. Therefore, it is possible to form the xenon short arc lamp for a digital projector with a long usage life span.

(7) According to the seventh invention, in a short arc lamp for a digital projector can have a tantalum getter, by controlling the molar amount of the tantalum getter according to the amount of carbon in the lamp, there remains an advantage that the starting performance thereof is excellent since impurity gas such as hydrogen gas ($H_2$) can be removed by the tantalum getter. In addition, the amount of CO that is absorbed and stored by the tantalum getter can be controlled, so that CO can be supplied certainly thereto in a gaseous state, and formation of unevenness on the tip face of the cathode can be prevented over a long time period, whereby the flicker phenomenon can be suppressed for a long time, thereby extending the usage life span.

(8) According to the eighth invention, in the xenon short arc lamp for a digital projector having a tantalum getter, since the tantalum getter can be attached to a potion where the attained temperature of the getter becomes 1,400° C. or more during lamp lighting, the CO that is absorbed and stored during a lighting-out period of the lamp is discharged during lamp lighting, so that it is possible to supply certainly the CO to the tip of the cathode in a state of a gaseous phase. Therefore, it is possible to prevent generation of unevenness on the tip face of the cathode over a long time period, thereby forming a xenon short arc lamp for a digital projector with a long usage life span.

BRIEF DESCRIPTION OF THE DRAWINGS

Other features and advantages of the present xenon short arc lamp for a digital projector will be apparent from the ensuing description, taken in conjunction with the accompanying drawings, in which:

FIG. 4 is a table showing specifications of each lamp according to embodiments of the present invention and reference examples, and a life span as to a flicker of each lamp;

DESCRIPTION

Figure 1:
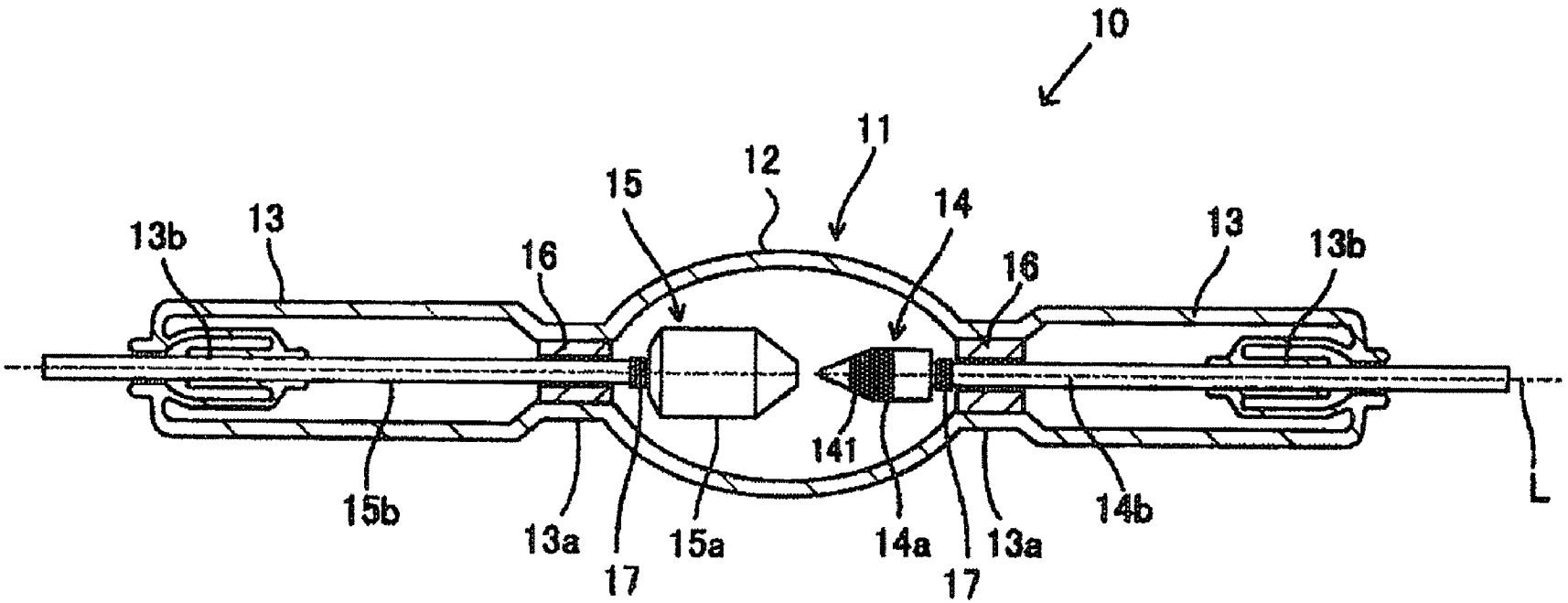
FIG. 1 is an explanatory cross sectional view of the structure of a xenon short arc lamp for a digital projector according to an embodiment of the present invention.

FIG. 1 is an explanatory cross sectional view of the structure of a xenon short arc lamp for a digital projector (hereinafter referred to as a "xenon lamp" or simply referred to as a "lamp"), according to embodiments of the present invention. The xenon lamp 10 comprises an arc tube 11 made of silica glass, and a cathode 14 and an anode 15 which are provided so that tips thereof face each other within an arc tube portion 12. The arc tube 11 is made up of the arc tube portion 12 which is made from a glass tube having an expanded portion formed around a center thereof, and sealing portions 13 which are respectively formed continuously from both ends of the arc tube portion 12. A main body portion 14*a* of the cathode 14 is made of tungsten that contains electron emissive material, and a main body portion 15*a* of the anode 15 is made of tungsten. Thus, the tungsten is mainly adopted as material that forms the main body portions 14*a* and 15*a* of the electrodes, since tungsten is an advantageous material in the present invention, that is, it has a high melting point, the vapor pressure thereof is low, and the thermal conductivity thereof is high. Of course, the material of the cathode and anode main body portions 14*a* and 15*a* of the electrodes is not limited to that having 100% of the above material component, impurities that are ineluctably mixed may be contained therein. In addition, a carbonization layer and other substances may also be additionally provided in the cathode main body 14*a* and/or the anode main body 15*a*. Thus, the cathode main body 14*a* and the anode main body 15*a* are respectively attached to and held by electrode rods 14*b* and 15*b* so as to be located in the center of the arc tube portion 12. While the electrode rods 14*b* and 15*b* are inserted into respective holes of cylindrical silica glass members 16, each of which has a large thickness and which is held in a narrowed down portion 13*a* formed between the arc tube portion 12 and the sealing portion 13, and are sealed air tight and held by glass connection members 13*b* formed at both ends of the arc tube portion 12. The electrode rods 14*b* and 15*b* are projected and extend outward from the respective outer end portions of the arc tube 11, and serve as lead portions for electric supply, which supplies electric power to the xenon lamp 10. Moreover, xenon gas is enclosed as light emitting material inside the arc tube 11.

The standard specification of the xenon short arc lamp for a digital projector that satisfies the requirement of the present invention will be given below. The pressure of enclosed xenon is 1 MPa or more, the bulb wall loading is 30 W/cm$^2$ or more, and the current density of the tip face of the cathode is 119 A/mm$^2$ or more. In a light source used for a digital projector for a DLP, such specification is required at minimum in order to illuminate a screen more brightly, and in order to condense light with high efficiency at an irradiated area that is approximately the same size as that of a DMD element, specifically whose diagonal line of the small area is as short as a 0.7-1 inch (17.8-25.4 mm). Moreover, in order to realize the above large current density, it is desirable that thoria ($ThO_2$) be used as the electron emissive material contained in the cathode 14, and it is desirable that the cathode main body portion 14*a* be made of thoriated tungsten. Moreover, the anode main body 15*a* of the anode 15 becomes high in temperature by receiving arc radiation and electrons, so that it is desirable that material of the anode main body 15*a* be tungsten with a high melting point. Moreover, in such a xenon short arc lamp 10, in order to improve the starting performance of the lamp, it is desirable to arrange a getter 17 inside the arc tube 11.

Figure 2:
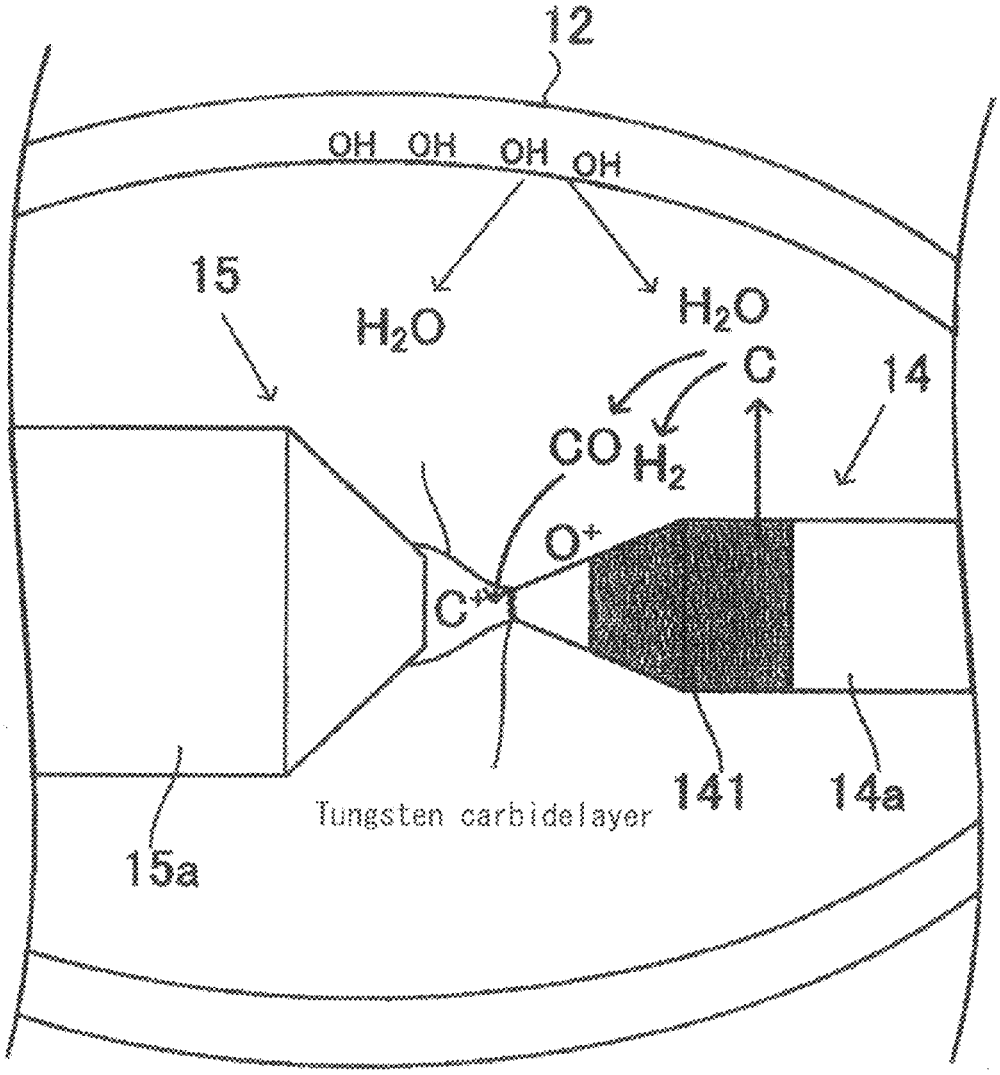
FIG. 2 is an explanatory diagram showing an embodiment of a tip portion of a cathode structure according to the present invention.

FIG. 2 shows an embodiment of a tip portion having the cathode structure according to the present invention. A cone angle of the tip portion of the cathode main body 14*a*, which is hypothetically formed by the taper surface (ridgelines), is 60 degrees. The diameter of the tip is in a range of 0.35-1.0 mm, and the diameter of a thick diameter portion is 4-12 mm. By forming the diameter of the tip of the cathode so as to be small in this way, rays from an arc which is blocked by the cathode itself can be reduced, and an optical output from the lamp can be increased.

In order to supply carbon (C) to a portion that is covered with an arc in the tip of the cathode, the xenon lamp 10 contains carbon inside the arc tube 11. As one of forms, for example, it is possible to provide carbon therein by providing a tungsten carbide ($W_2C$) layer 141 near the tip of the cathode 14*a*, as shown in FIG. 2. The portion in which the tungsten carbide layer 141 is formed is receded by at least 2 mm from the tip face of the cathode 14*a* along a direction of an axis L of the electrode, and the thickness of the layer is 30-100 μm (micrometers). Thus, the tungsten carbide layer 141 is not (should not be) formed at the tip of the cathode. This is because when the tungsten carbide ($W_2C$) having a low melting point is formed in range of about 30 μm or more in thickness, there are problems in that the meltage of the tip portion of the cathode becomes excessive so that the diameter of the cathode tip becomes large in a short time whereby the luminosity thereof decreases, or an inner surface of the arc tube is blackened due to evaporation of tungsten carbide ($W_2C$) so that the intensity of a radiation light decreases. Thus, there is a problem that the life span of the lamp comes to the end at an early stage.

A means for providing carbon or compound containing carbon which serves as a source of supplying carbon in the arc tube 11 is not limited to those described above. Any form thereof can be adopted as long as it is a method of attaching it to a metal portion of the inside of the arc tube. For example, a tungsten carbide ($W_2C$) layer may be provided on the anode main body 15*a*, or carbide may be arranged to the axis portions 14*b* and 15*b* of the respective electrodes 14 and 15. In addition, when such a carbonization layer is formed on the anode main body 15*a*, it is desirable to form it thereon except for an area of the tip portion, as in the case where it is provided on the cathode main body 14*a*.

It is difficult to realize that carbon is stably supplied to the tip of the cathode 14*a* in a state of a gaseous phase by only arranging carbon or compound containing carbon in a solid state in the arc tube 11. Various methods can be considered as a means for changing carbon into a gaseous phase state such as carbon dioxide. As an example, CO can be generated by providing oxygen (O) in the arc tube 11, so that carbon can be supplied certainly to the tip face of the cathode. One form is to make the silica glass, which forms the arc tube 11, contain a lot of OH group. As a desirable form, a layer having an OH group concentration of 100 wt-ppm or more, is formed on the inner surface of the arc tube 11. The OH group concentration of the inner surface layer is defined as an average concentration in a thickness range from the inner surface to 150 μm. Furthermore, in a preferable form, the quantity of the OH group contained in the arc tube 11 is 0.15 μmol/$cm^3$ or more per unit internal volume of the arc tube.

In such a xenon short arc lamp, the OH group contained in the silica glass of the inner surface layer in the arc tube 11 is discharged in the electrical discharge space as water ($H_2O$) or oxygen ($O_2$) during lamp lighting, and reacts with the supply source of carbon (that is, carbon or carbon compounds) contained in the inside of the arc tube 11, thereby generating carbon monoxide gas (CO). When the CO diffuses in a state of a gaseous phase in the arc tube 11, part thereof enters into an arc. In the arc, the CO is broken down due to high temperature, thereby generating C+ ions. These C+ ions are carried to the tip face of the cathode by a electric field in the arc, and react with tungsten of the cathode 14*a*, thereby generating the carbide of tungsten, such as $W_2C$ and WC. Although the carbide of tungsten is exposed to the high temperature in the cathode 14*a* and melts thereby, since the C is brought about from the gaseous phase, the melted amount is small. Therefore, there is no problem that the tip of the cathode 14*a* becomes large in a short time so that the luminosity thereof decreases. Or there is no problem in that the inner surface of the arc tube is blackened by evaporation of the carbide of tungsten.

If such a small amount of carbon exists during light-out of the lamp, the carbide of tungsten in shape of two or more lines is formed with a stripes-like pattern on the tungsten tip face of the cathode. Even if unevenness is formed at the tip of the cathode, a smooth spherical surface is formed on the tip of the cathode with surface tension, thereby reforming a smooth face, because the carbide of the tungsten generated to the extent that it remains in the minute range on the tip face of the cathode, is melted during lamp lighting.

Figure 3A:
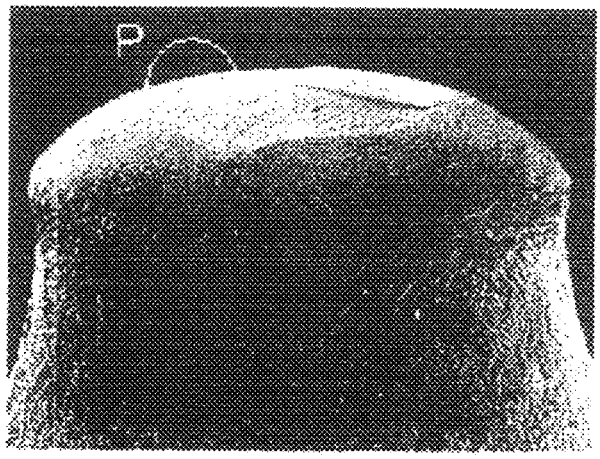
FIGS. 3A and 3B show an electron microscope photographs of a tip of a cathode according to the present invention.
Figure 3B:
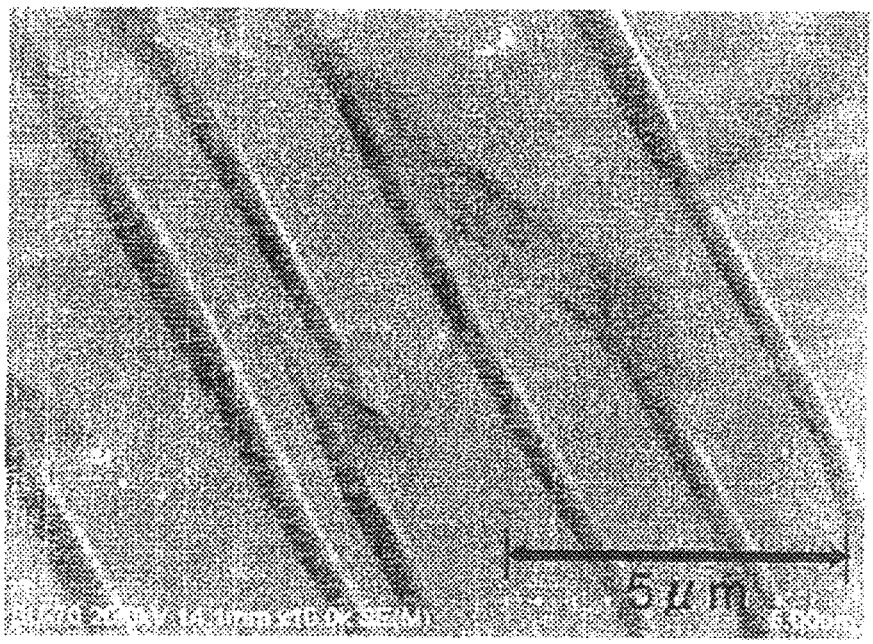

FIGS. 3A and 3B show enlarged electron microscopic photographs showing a surface portion of the tip of the cathode. Here, FIG. 3A is an enlarged photograph showing a tip end portion, and FIG. 3B shows an enlarged photograph of a circled portion P of FIG. 3A. As shown in FIG. 3B, specifically, the carbide of tungsten forms a stripes-like pattern that is aligned and generated in the form of many lines in a tungsten (W) phase, which is the main component of the main body portion. The width of the phases of the carbide of the tungsten with the stripe pattern is approximately 0.1-0.5 μm, and the many phases are respectively formed at an interval of approximately 0.5-3 μm. A percentage of the carbon at the tip of the cathode is approximately 1 wt %, wherein the percentage of the carbon is the highest in the surface layer of the tip of the cathode, and it becomes lower as a position thereof recedes rearward from the tip. It is confirmed that the carbon has been carried to the tip of the cathode by the gaseous phase.

In order to certainly realize the supply of C in such gaseous phase, the quantity of carbon (C), which is provided in the inside of the arc tube, is desirably 2.4 μmol/$cm^3$ or more in the internal volume of the arc tube. By providing carbon of 2.4 μmol/$cm^3$ or more per unit internal volume of the arc tube, it is possible to always supply the carbon in a gaseous phase state, which reaches the tip of the cathode, so that a life span in terms of flicker can be extended. In addition, the "quantity of carbon" is a numerical value obtained by calculating the total quantity of carbon (C) from all carbon and carbon compounds adhering to members made of metal in the inside of the arc tube including the arc tube portion and the sealing portions, and then converting the total quantity into molar quantity, and further dividing it by the internal volume of the arc tube.

In addition, as mentioned above, when the silica glass that forms the arc tube is made to contain a lot of OH groups in order to realize that carbon is supplied to the tip of the cathode by a gaseous phase, a problem in electric discharge does not occur during lamp lighting, since $H_2$ is generated based on the OH group in a process of a reaction. However, since the lamp starting nature is worsened if it exists at a start-up time, it may cause a problem. Therefore, in order to maintain the good starting performance, it is desirable to provide a getter, which absorbs and stores $H_2$, in the inside of the arc tube. It is desirable to use tantalum for the getter, when the stability to the $H_2$, and the stability in the inside of the arc tube, etc. are taken into consideration. In addition, although tantalum is in general made of simple metal, a reaction such as oxidization may take place in the surface thereof. Even if it is made of such a compound of tantalum in which a small quantity of oxide is formed, the same function can be obtained as a getter. In addition, while the tantalum getter can improve the starting performance, it has the characteristic of absorbing and storing carbon dioxide (mainly CO gas) generated in a process of gasification of the carbon. For this reason, the mechanism of the present invention of supplying the carbon in a gaseous phase state to the tip of the cathode may be impaired. Therefore, in order to prevent such a situation in advance, it is desirable to set the quantity of the tantalum contained in the getter so that the molar ratio thereof to carbon may be 11 or less. Of course, it is presupposed that, in order to absorb and store $H_2$ in the tantalum getter thereby acquiring the starting stability, the required quantity thereof is provided in the arc tube. The above-mentioned molar ratio requirement does not include 0 (zero). The quantity of the optimal tantalum may be suitably set up, based on the quantity of carbon and the quantity of OH group in the arc tube, taking the starting performance and a life span as to a flicker, into consideration. The CO can be carried to the tip of the cathode without depletion during lamp lighting by controlling the quantity of the tantalum arranged in the inside of the arc tube 11 as in this embodiment, thereby suppressing generation of a flicker phenomenon for a long time and extending a usage life span of the lamp. In addition, since impurity gas, such as hydrogen gas ($H_2$), is removed by the tantalum getter during light-out of the lamp, it is possible to make a lamp that is excellent in starting performance. Here, in order to remove the impurity gas such as $H_2$, the getter may be made of other substances such as zirconium (Zr), instead of the tantalum. In that case, it is possible to adjust the ratio of the quantity of carbon and the getter quantity, or the position where the getter is arranged, based on the quantity of absorbed and stored CO or discharge temperature.

Moreover, in the lamp that is equipped with the tantalum getter, by arranging the getter in a position where it becomes 1,400° C. or more during lamp lighting, it becomes possible to acquire the same effects as those in the case where the molar ratio of the tantalum to the carbon is controlled, i.e., the effects of carrying CO to the tip of the cathode and of improving the starting performance. In this embodiment, it is desirable to arrange such a getter in a position where the attained temperature becomes 1,400° C. or more as a whole. When such a getter is arranged so as to approximately lie astride a boundary between the position where it becomes 1,400° C. or more and a position where it becomes less than 1400° C., it is desirable to make small the quantity of the getter arranged at the position where it becomes less than 1,400° C., by balancing the amount of absorbed and stored CO and a discharged quantity thereof. In addition, as to the attained temperature of the getter, since the temperature of the inside of the getter is considered to be equivalent to that of the surface temperature thereof, it is good to measure it by using a radiation thermometer.

Figure 8:
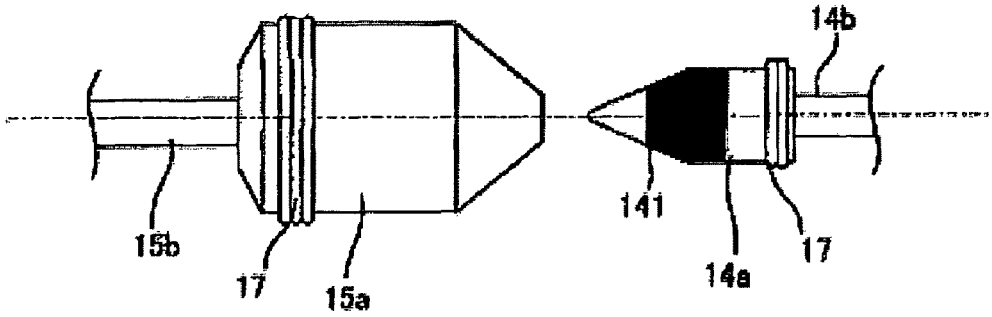
FIG. 8 is a diagram of another arrangement example of a getter according to another embodiment of the present invention.
Figure 9:
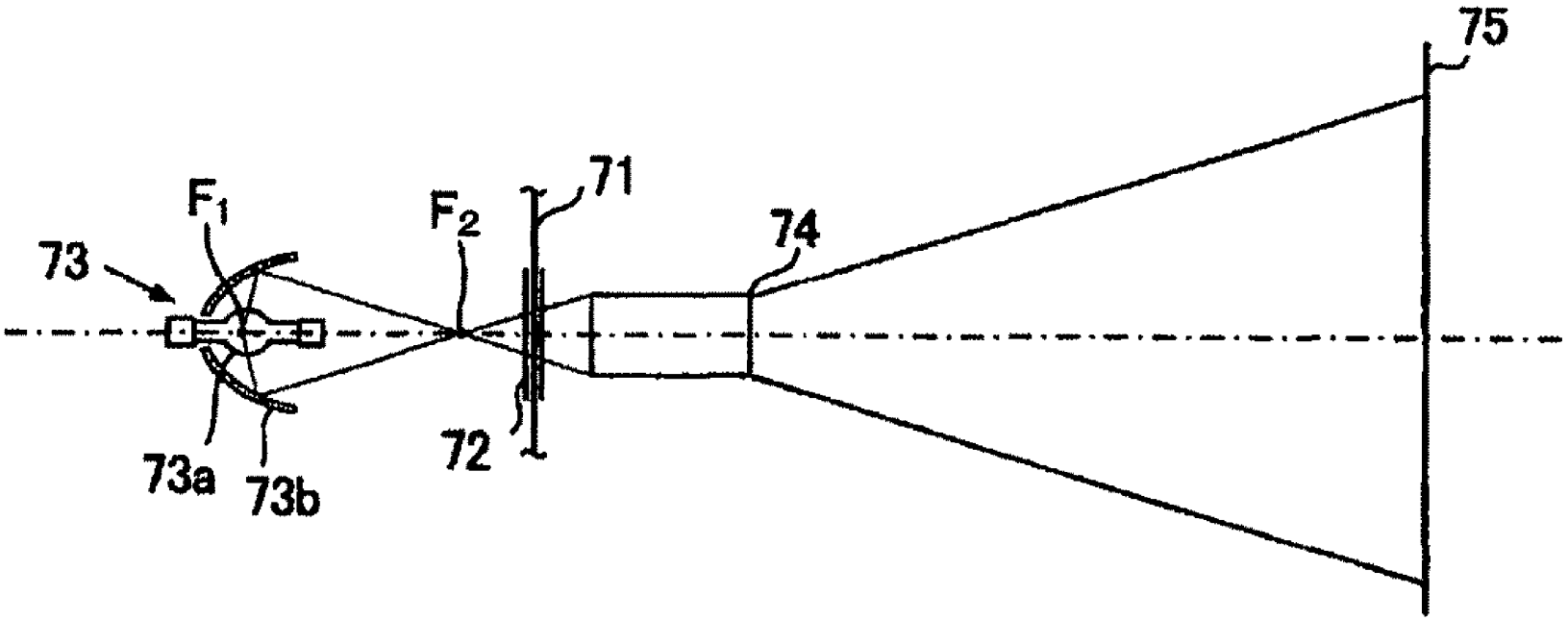
FIG. 9 PRIOR ART
FIG. 9 is an explanatory diagram of the structure of a projector for a film.
Figure 10:
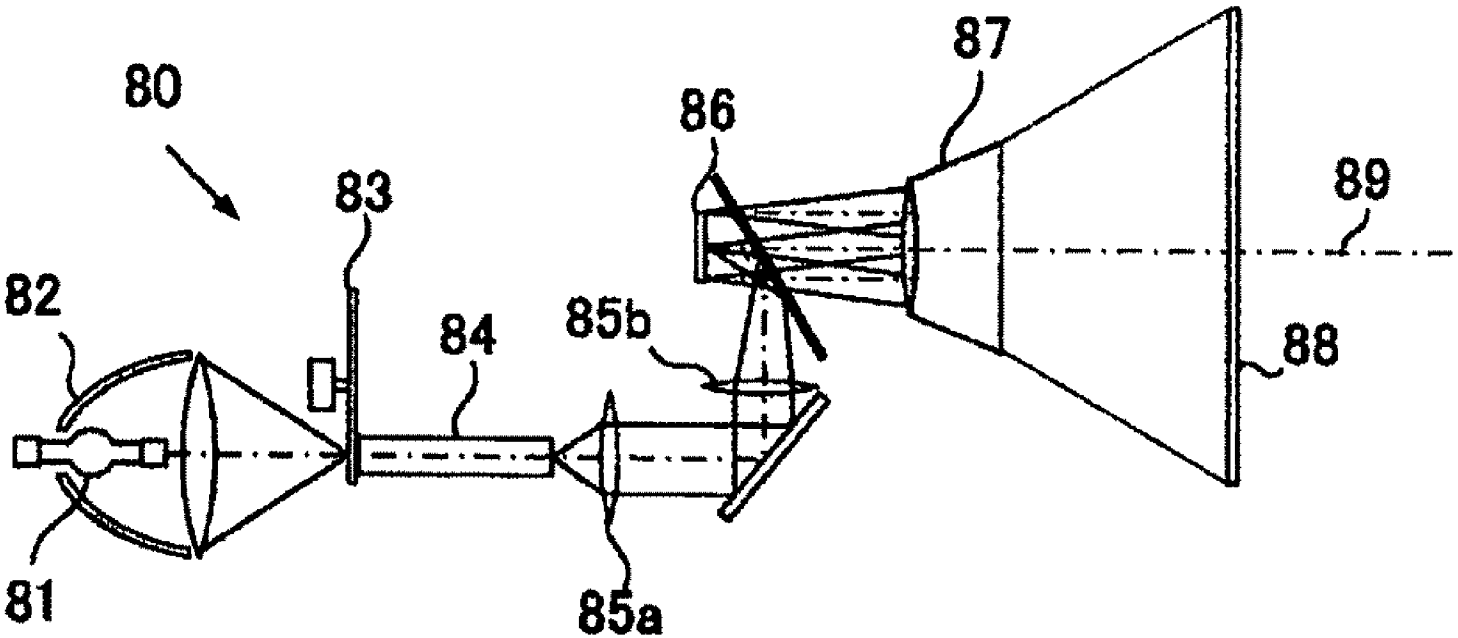
FIG. 10 PRIOR ART
FIG. 10 is an explanatory diagram of the structure of a projector for a DLP.

FIG. 8 is an explanatory diagram of another embodiment of the present invention, which shows an example in which tantalum getters are respectively arranged to the cathode main body 14*a* and the anode main body 15*a*. Since CO is absorbed and stored by the tantalum getter 17 during light-out of the lamp is discharged during lamp lighting when the temperature rises to 1,400° C. or more, the CO does not become insufficient and generation of a flicker phenomenon is controlled for a long time, so that the lamp has a long usage life span. In addition, during light-out of the lamp, since impurity gas such as hydrogen gas ($H_2$) is removed by the tantalum getter, the lamp becomes excellent in starting performance.

The present invention will be described based on experimental examples below. Xenon short arc lamps 1-9 whose specifications differ from one another were made based on the basic configuration shown in FIG. 1. The specifications of the lamps 1-9 are collectively shown in a table of FIG. 4. The lamp 1 was a reference example in view of the present invention, wherein it was a conventional xenon lamp for a projector that was used for a movie film. Rated power consumption thereof was 3,500 W, the diameter of a cathode at a tip electrode was 0.9 mm, the current density thereof was 104 A/cm$^2$, and the bulb wall loading of the lamp was 20.6 W/cm$^2$ and the cone angle at the tip of the cathode was 40 degrees. The inner surface area of this arc tube was 170 cm$^3$, the internal volume thereof was 217 cm$^3$, and the pressure of the enclosed xenon gas that was converted into that at normal temperature (25° C.) was 0.6 MPa. Each of the lamps 2-9 was a digital xenon lamp for a projector for a DLP, wherein the basic specifications were the same as one another. The rated power consumption was 4,000 W, the diameter of the tip of the cathode was 0.6 mm, the current density thereof was 119 A/cm$^2$, and the bulb wall loading of the lamp was 37.5 W/cm$^2$ and the cone angle at the tip of the cathode was 60 degrees. The inner surface area of this arc tube was 170 cm$^2$, the internal volume thereof was 135 cm$^3$, and the pressure of enclosed xenon gas, which was converted into that at normal temperature (25° C.), was 1.6 MPa. According to such specifications, light could be condensed on a small area whose diagonal line was as short as a 0.7-1 inch (17.8-25.4 mm).

Moreover, definition of each item in the table of FIG. 4 will be given below. The "current density" means current density that is obtained by dividing lamp current by a cross section area at a position of 0.5 mm from the tip of the cathode, and the unit thereof is A/cm$^2$. The "bulb wall loading" is a value that is obtained by dividing lamp electric power by the inner surface area at a portion where the arc tube is swollen (arc tube portion), wherein the unit thereof is W/cm$^2$. The "OH concentration of arc tube inner surface" is an average OH group concentration in a thickness range of 150 μm from the inner surface of the arc tube. Moreover, the "OH concentration of inside of arc tube" is an OH group concentration at the center between the inner and outer surfaces of the arc tube (approximately a ½ portion of the thickness thereof). The inner side of the arc tube is etched by hydrofluoric acid, and the OH group concentration in the silica glass of such an arc tube can be calculated from the relation between the depth of etching and absorbance of infrared light. The "OH group quantity/inner volume" means molar numbers per unit volume, which is obtained by dividing the OH group quantity that exists in the inner face (150 μm) of the arc tube portion (only the swollen portion of the arc tube), by the total internal volume of the lamp including the arc tube portion and the sealing portions. The "carbon quantity/inner volume" means molar quantity per unit volume, which is obtained by dividing the molar quantity of carbon containing carbon and carbon compounds that adhere to portions including the main body portions of the electrodes and the axis portions of the electrodes by the internal volume of the arc tube (the arc tube portion and the sealing portions). The "tantalum quantity/carbon quantity molar ratio" means molar numbers of the tantalum to one mole of carbon that exists in the inside of the arc tube (the arc tube portion and the sealing portions). The "temperature of tantalum getter" was measured by using a radiation thermometer. In addition, in this experimental example, a tantalum wire with a diameter of 0.5 mm was used as a getter, and it may be considered that the surface temperature and the internal temperature of the getter are the same as each other. Moreover, since change of the luminance distribution of the lamp due to generation of a flicker has a correlation with change of lamp voltage, and it is regarded that a flicker occurred on a screen when a fluctuation range of lamp voltage exceeded 1 V, lighting time for the fluctuation range of lamp voltage to reach 1 V, was measured in a single uniform way as the "life span as to flicker".

Reference Example 1

A lamp 1 (reference example 1) was a xenon short arc lamp used as a light source of a projector for a movie film. The arc tube was manufactured by using dried gas ($N_2$) when the arc tube was blown up in its molding process. Since both the "OH concentration of inside of arc tube" and the "OH concentration of arc tube inner surface" were approximately 5 wt-ppm, the OH group concentration of the inner surface of the arc tube was maintained to a level of that of raw material in a pre-molding state. Moreover, a carbonization layer was formed on the surface of the taper portion of the cathode of the lamp 1, except the tip of the main body portion, by a conventionally known method. The tantalum getters were respectively attached at the positions immediately behind the cathode main body 14*a* of cathode axis portion 14*b* and the anode axis portion 15*b* of the anode main body 15*a* in order to absorb $H_2$, thereby improving the starting performance of the lamp. When this lamp 1 was turned on, a life span as to a flicker was 3,500 hours so that a long usage life span could be acquired. Furthermore, analysis of the lamp showed that carbon of 1.8 μmol/cm$^3$ per unit internal volume of the arc tube existed inside the arc tube (including both the arc tube portion and the sealing portions) including the carbonization layer of the tip of the cathode.

Reference Example 2

The lamp 2 (Reference Example 2) was a xenon short arc lamp for a digital projector with a DLP, and the enclosure pressure, the current density of the tip of the cathode, and the bulb wall loading of the lamp were respectively set up so as to be high in order to make the lamp with high intensity. The concrete specification thereof is described above. In a forming step of the arc tube, when the arc tube was blown up, dried gas ($N_2$) as in the above-mentioned lamp 1 was used, and the OH group concentration in the inner face of the arc tube was maintained to a level of raw material in a pre-formation state thereof, which was as low as 5 wt-ppm. Moreover, while the carbonization layer was formed on the surface of the taper portion of the cathode main body by the conventionally known method as in the lamp 1, the tantalum getter was arranged inside the arc tube. When the lamp 2 was turned on, the life span as to a flicker became 260 hours, which was much shorter than that of the lamp 1. Furthermore, when the lamp 2 was analyzed, the total quantity of carbon in the inside of the arc tube was 2.1 μmol/cm$^3$ per unit internal volume of the arc tube. In addition, the molar ratio of tantalum to carbon, which forms the getter, was 31.

Figure 5:
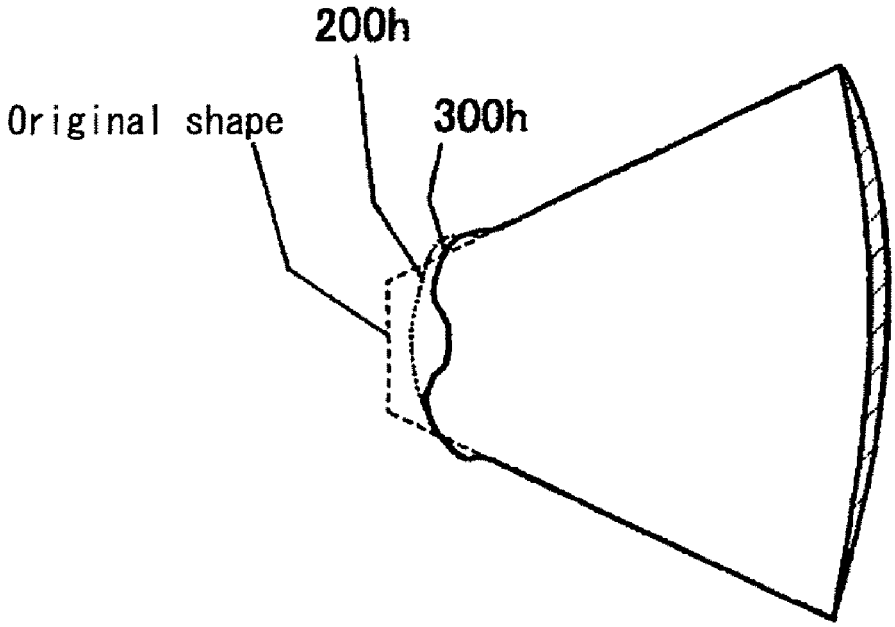
FIG. 5 is a diagram showing change of the shape of a tip of a cathode of a lamp 2 according to a reference example 2.

FIG. 5 schematically shows a state of deformation of the tip of the cathode when observing the flicker phenomenon in the lamp 2. Although it was maintained in a smooth state in 200 hours after it was turned on, when the tip of the cathode was deformed so that unevenness was formed, it was confirmed that an electric discharge starting point moved between a convex portion and another convex portion (arc jumping), so that a flicker began to occur. That is, even if the cathode tip was greatly worn out so that a tip face thereof became large, electric discharge was stable. However, if the deformation progresses further so that unevenness was formed in the tip face thereof, an electric discharge starting point moved between convex portions, thereby generating a flicker there. Since the temperature of the tip portion of the cathode was high in the lamp with the specification of high load, which was made for the present reference example, such deformation may progress fast, so that it is considered that a life span as to a flicker was short.

Further, two or more lamps with the same specification as that of the lamp 2 were lighted, and then the cathode of the lamp in which a flicker had not occurred (before occurrence of a flicker), and the cathode of the lamp in which a flicker occurred (after occurrence of a flicker), were analyzed by an X ray photoelectron spectroscopy apparatus (XPS). As a result, although carbide of tungsten existed in the cathode tip portion of the lamp before a flicker occurred (the former), it did not exist in the cathode tip portion of the lamp after the flicker occurred (the latter). Therefore, the present inventors inferred that, when carbon was moved to the cathode tip portion, thereby generating carbide of tungsten, unevenness was not formed in the cathode tip face, but when the carbide of tungsten was no longer generated, unevenness was formed on the tip face of the cathode, thereby generating a flicker.

Such a phenomenon will be summarized below. Water in the arc tube and carbon in the arc tube reacted with each other so as to generate CO which became diffuse in a gaseous phase of the electrical discharge space and was moved to the cathode tip portion. For more detail, if the CO diffused in the gas and entered the inside of the arc, dissociation and ionization took place due to high temperature, and C+ ions were moved to the face of the cathode tip by the electric field in the arc. Therefore, in order to improve a life span as to a flicker, it was required to maintain generation of CO over a long time.

Reference Example 3

The lamp 3 (Reference Example 3) was a lamp that used an arc tube in which OH group concentration of an inner surface layer was high, so as to serve as a supply source of water over a long time. The lamp 3 having the same structure as that of the lamp 2 except for the structure relating to the concentration of OH group, was manufactured.

Here, a layer, in which the OH group concentration was high, was formed on the inner surface of the arc tube glass, for example, as set forth below. That is, in the arc tube forming step in which the arc tube was blown up, the layer, in which the OH group concentration was high, was formed in the inner surface of the arc tube glass by filling the silica glass tube heated to more than working temperature, with pressurization gas including water vapor. The pressurization gas was made to contain the vapor by making it pass through water. In addition, it was possible to control the quantity of the vapor which the pressurization gas contained, and the OH group concentration of the inner surface layer of the arc tube, by adjusting the water temperature. For example, when the silica glass tube heated to 2,500° C. was blown up using the pressurization gas (nitrogen) which passed through water of 25 degree Celsius, it was possible to form, in approximately 2 minutes, the inner surface layer of the arc tube, which had approximately 150 μm thickness, in which an average OH group concentration was raised to approximately 100 wt-ppm. Moreover, if the water temperature was 80° C. and the other processing conditions were the same, the average OH group concentration in a thickness of approximately 150 μm was approximately 350 wt-ppm.

In such a way, the surface layer of the arc tube inner which had approximately 150 μm thickness, in which an average OH group concentration was raised to approximately 100 wt-ppm, was produced. The specification thereof is shown in detail in a table of FIG. 4. However, in this lamp 3, the improvement effect of a life span as to a flicker also remained small. This is because the quantity of carbon was insufficient although water supply for generating the CO increased.

Embodiment 1

The lamp 4 (Embodiment 1), in which the quantity of the carbon in the arc tube was increased, was manufactured. In addition, the lamp 4 (Embodiment 1) was the same as the lamp 3 (Reference Example 3) in that the arc tube, in which the high OH group concentration of the inner surface layer was increased, was used as a water supply source over a long time. Here, although various methods for increasing the quantity of carbon could have been examined, in this embodiment, it was increased by increasing an area of the cathode surface which was carbonized. The quantity of the carbon that exists inside the arc tube, i.e., the quantity of the carbon provided in the carbonization layer of the cathode or the anode, could be adjusted, for example, in a carbonization layer formation process, by changing the quantity of the embrocation containing carbon, the area where the carbonization layer is formed, and the temperature of a high temperature carburization process, etc. When lighting experiment of the lamp 4 was made, the life span as to a flicker was extended to 470 hours, so that the unprecedented improvement was confirmed. It is believed that generation of the CO and supply of the carbon to the cathode tip were maintained over the long time due to sufficient quantity of carbon and moisture discharged from the inner surface of the arc tube. Furthermore, as a result of analyzation of the lamp 4, the quantity of the carbon which existed inside the arc tube was 2.4 μmol/cm$^3$ per unit internal volume of the arc tube.

Embodiment 2

The lamp 5, whose structure was the same as that of the lamp 4 (Embodiment 1), except that the quantity of carburization to the cathode was further increased, was produced. When this lamp 5 was lighted, a life span as to a flicker was 540 hours, so that the usage life span thereof could be further extended. When the quantity of carbon in this lamp 5 was analyzed, it was 3.0 μmol/cm$^3$ per unit internal volume of the arc tube.

Embodiment 3

Figure 6:
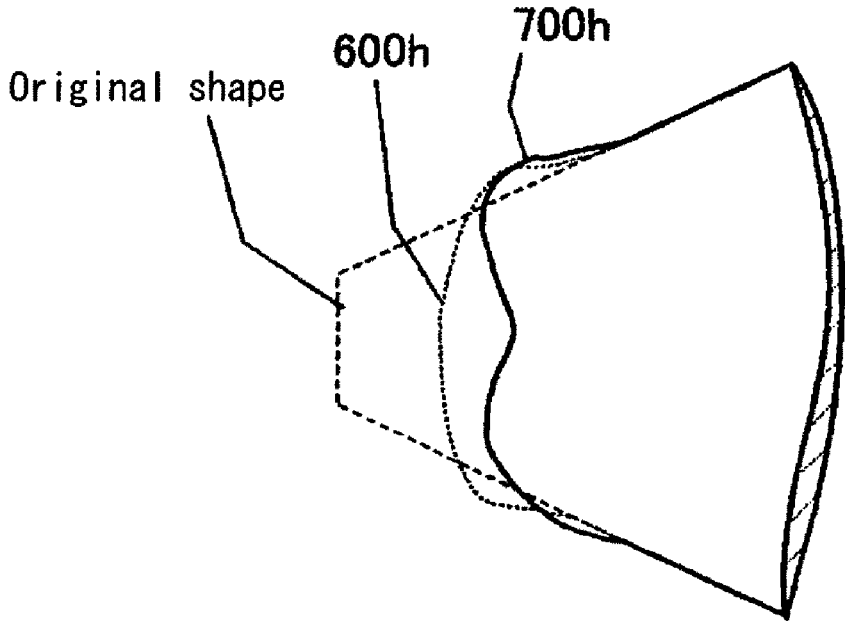
FIG. 6 is a diagram showing change of the shape of a tip of a cathode of a lamp 6 according to a third embodiment 3.

The lamp 6, whose structure was the same as that of the lamp 5 (Embodiment 2), except that the OH group concentration of the inner surface layer of the arc tube was further increased, was produced. The OH group concentration of the inner face of the arc tube of the lamp 6 was 350 wt-ppm. FIG. 6 shows change in shape of the cathode tip of the lamp 6 (Embodiment 3). The life span as to a flicker of this lamp 6 was 650 hours, so that the usage life span thereof could be further extended. When the quantity of carbon in this lamp 6 was analyzed, it was 0.54 μmol/cm$^3$ per unit internal volume of the arc tube.

Embodiment 4

Figure 7:
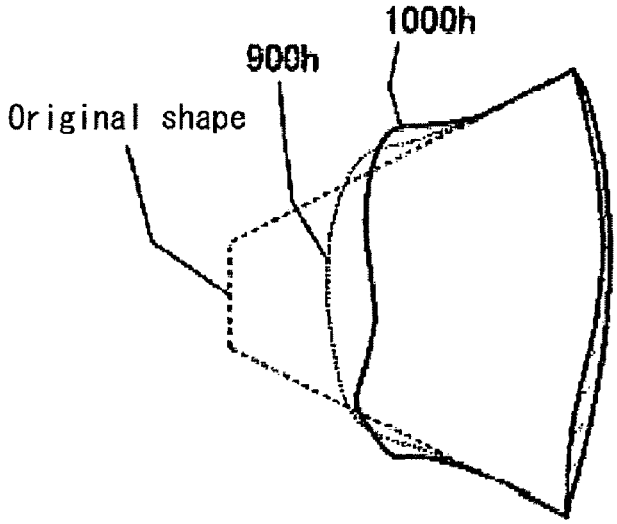
FIG. 7 is a diagram showing change of the shape of a tip of a cathode of a lamp 7 according to an embodiment 4.

The lamp 7, whose structure was the same as that of the lamp 6 (Embodiment 3), except that the quantity of carburization to the cathode was further increased, was produced. FIG. 7 shows change in shape of the cathode tip of the lamp 7 (Embodiment 4). The life span as to a flicker of this lamp 7 was 910 hours, so that the usage life span thereof could be further extended. When the quantity of the carbon in this lamp 7 was analyzed, it was 5.2 μmol/cm$^3$ per unit internal volume of the arc tube.

The lamps 4-7 (Embodiments 1, 2, 3 and 4) will be examined below. It turned out that the life span as to a flicker became longer, as the quantity of carbon was increased and the OH group concentration became higher. Moreover, as shown in FIGS. 6 and 7, it turned out that a concavo-convex portion at the tip of the cathode of the lamp 7 (Embodiment 4), in which the quantity of carbon was large, was generated later than the others.

Incidentally, in each of the lamps 1-7, the getter made of tantalum was standardly provided. When moisture existed in the lamp, $H_2$ was generated, the starting performance of the lamp worsened. Therefore, the tantalum getter was provided in order to prevent this, but since those other than CO were absorbed and stored, it was considered that carbon supply to the cathode tip may have been prevented thereby. Therefore, the present inventors made the lamp in which the tantalum quantity (the ratio of the molar number to that of carbon) was 11 or less.

Embodiment 5

The lamp 8 (Embodiment 5), which was a xenon short arc lamp, was produced, wherein the quantity of a tantalum getter was a half of that of the above-mentioned lamp 6 (Embodiment 3), based on the consideration which is mentioned above. In addition, the basic specification other than that of the tantalum getter was the same as that of the lamp 6. When the lamp 8 (Embodiment 5) was evaluated, the life span as to a flicker was improved, compared to the lamp 6. It was considered that when CO, which was absorbed and stored in the tantalum getter, decreased, supply of carbon to the tip of the cathode was maintained over a longer time.

Incidentally, in each of the lamps 2-8, the tantalum getter was arranged on the axis portion of an electrode, as shown in FIG. 1. It was found from measurement by a radiation thermometer that the attained temperature of the getter was approximately 1,300° C. during lamp lighting. Although the tantalum absorbed and stored CO during light-out of the lamp, it discharged the CO when the temperature went up to 1,400° C. or more. Therefore, the present inventors made the lamp 9 (embodiment 6) which had the same specification as that of the lamp 6 (Embodiment 3), except that only the arrangement portion of the tantalum getter was different therefrom. In this lamp 9, as shown in FIG. 8, when the tantalum getters were arranged on the cathode main body and the anode main body, the attained temperature of the getter could be made to 1,400° C. or more. The CO, which was absorbed and stored in the tantalum during light-out of the lamp, was discharged during lamp lighting when it was heated to 1,400° C. or more, and the C was supplied to the tip of the cathode without depletion of the CO during lamp lighting. And since the impurity gas such as hydrogen gas ($H_2$), was absorbed and stored in the tantalum getter during light-out of the lamp and was removed from the electrical discharge space, the lamp became excellent in the starting performance. The life span as to a flicker of this lamp 9 was 780 hours, and it was confirmed that a life span thereof was improved, as compared with the lamp 6 whose attained temperature of the tantalum getter was approximately 1,300° C. In addition, when the quantity of the carbon in this lamp 9 was analyzed, it was 3.0 μmol/cm$^3$ per unit internal volume of the arc tube.

In the lamps 4-9 according to the above embodiments, the tantalum getters were used in order to remove the impurity gas, such as $H_2$, but other getters, such as that made of zirconium (Zr), could also be used. In that case, the ratio of the quantity of carbon to that of the getters is suitably adjusted, and the position where the getter is provided, based on the quantity of absorbed and stored CO and/or discharge temperature.

In the lamps 1-9 according to the above reference example and the embodiments, the carbonization layer was mainly formed on the surface layer of the cathode as a supply source of carbon (C). Further, the present inventors examined as to how to extend a life span as to flicker, by arranging the supply source of carbon on a metal portion in the lamp, such as electrode portions, that is, the anode main body, the cathode axis portion, and the anode axis portion. It was confirmed that in any of the forms (positions), the same effects as those in the case where a carbonization layer was provided in the cathode, were acquired.

The preceding description has been presented only to illustrate and describe exemplary embodiments of the present xenon short arc lamp for a digital projector. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A xenon short arc lamp, comprising:

an anode;

a cathode having a cathode main body which is made of tungsten containing electron emissive material; and an arc tube made of silica glass, wherein a supply source of carbon is formed on a metal portion in the arc tube except a tip area of the cathode;

wherein in the arc tube, carbon and/or carbide of 2.4 μmol/cm$^3$ or more per unit internal volume of the arc tube when converted into carbon (C), is contained.

2. The xenon short arc lamp according to claim 1, wherein OH group concentration in an inner surface of the arc tube is 100 wt-ppm or more.

3. The xenon short arc lamp according to claim 1, wherein a quantity of OH group contained in the arc tube is 0.15 μ/cm$^3$ or more per unit internal volume of the arc tube lamp.

4. The xenon short arc lamp according to claim 1, wherein a getter made of tantalum or tantalum compound is provided in the arc tube, and wherein a molar ratio of the tantalum to the carbon, which is contained in the getter, is 11 or less.

5. The xenon short arc lamp according to claim 1, wherein a getter made of tantalum or tantalum compound is provided in the arc tube, and wherein the getter is attached to a potion where the attained temperature of the getter becomes 1,400° C. or more during lamp lighting.

6. The xenon short arc lamp according to claim 1, wherein a pressure of xenon gas enclosed inside the arc tube is 1 MPa or more, a bulb wall loading is 30 W/cm$^2$ or more and a current density of the tip face of the cathode is 119 A/mm$^2$ or more.

7. The xenon short arc lamp according to claim 1 wherein the carbon is supplied to the tip of the cathode through a gaseous phase during lamp lighting, so that a surface layer of the cathode melts.

8. A xenon short arc lamp comprising:

an anode;

a cathode having a cathode main body which is made of tungsten containing electron emissive material; and an arc tube made of silica glass, wherein a surface layer of a tip face of the cathode has stripe phases of tungsten carbide in a phase of tungsten (W);

wherein in the arc tube, carbon and/or carbide of 2.4 μmol/cm$^3$ or more in an arc tube volume when converted into carbon (C), is contained.

9. The xenon short arc lamp according to claim 8, wherein OH group concentration in an inner surface of the arc tube is 100 wt-ppm or more.

10. The xenon short arc lamp according to claim 8, wherein a quantity of OH group contained in the arc tube is 0.15 μ/cm$^3$ or more in an internal volume of the lamp.

11. The xenon short arc lamp according to claim 8, wherein a getter made of tantalum or tantalum compound is provided in the arc tube, and wherein a molar ratio of the tantalum to the carbon, which is contained in the getter, is 11 or less.

12. The xenon short arc lamp according to claim 8, wherein a getter made of tantalum or tantalum compound is provided in the arc tube, and wherein the getter is attached to a potion where the attained temperature of the getter becomes 1,400° C. or more during lamp lighting.

13. The xenon short arc lamp according to claim 8, wherein a pressure of xenon gas enclosed inside the arc tube is 1 MPa or more, a bulb wall loading is 30 W/cm$^2$ or more and a current density of the tip face of the cathode is 119 A/mm$^2$ or more.

* * * * *